US011499389B1

(12) United States Patent
Cook et al.

(10) Patent No.: US 11,499,389 B1
(45) Date of Patent: Nov. 15, 2022

(54) MODULAR CONTROL SYSTEMS WITH UMBILICAL DEPLOYMENT

(71) Applicant: FMC Technologies, Inc., Houston, TX (US)

(72) Inventors: James Cook, Houston, TX (US); Corey Massey, Houston, TX (US); Chad Vrla, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 17/465,523

(22) Filed: Sep. 2, 2021

(51) Int. Cl.
*E21B 33/076* (2006.01)
*E21B 34/04* (2006.01)
*E21B 43/26* (2006.01)

(52) U.S. Cl.
CPC ..... *E21B 33/076* (2013.01); *E21B 34/04* (2013.01); *E21B 43/2607* (2020.05)

(58) Field of Classification Search
CPC ..... E21B 33/076; E21B 34/04; E21B 43/2607
See application file for complete search history.

(56) References Cited

U.S. PATENT DOCUMENTS

| | | | | |
|---|---|---|---|---|
| 6,564,011 | B1 * | 5/2003 | Janoff | F16L 53/38 392/479 |
| 9,127,545 | B2 | 9/2015 | Kajaria et al. | |
| 9,938,866 | B2 * | 4/2018 | Borek | F16C 33/667 |
| 10,982,808 | B2 | 4/2021 | Zerkus et al. | |
| 11,022,526 | B1 * | 6/2021 | Yeung | F04B 17/05 |
| 11,111,768 | B1 * | 9/2021 | Yeung | E21B 43/2607 |
| 11,137,109 | B2 * | 10/2021 | Babineaux | F16N 11/08 |
| 11,220,895 | B1 * | 1/2022 | Yeung | E21B 43/2607 |
| 2003/0168518 | A1 * | 9/2003 | Beida | E21B 36/006 237/80 |
| 2010/0300696 | A1 * | 12/2010 | McCalvin | F16K 37/0041 166/336 |
| 2011/0233192 | A1 * | 9/2011 | Parman | E21B 36/04 219/548 |
| 2015/0285033 | A1 * | 10/2015 | Noel | H05B 3/56 392/301 |
| 2018/0223640 | A1 | 8/2018 | Keihany et al. | |
| 2020/0386359 | A1 | 12/2020 | Johnson et al. | |

* cited by examiner

*Primary Examiner* — Aaron L Lembo
(74) *Attorney, Agent, or Firm* — Osha Bergman Watanabe & Burton LLP

(57) ABSTRACT

A control unit includes a hydraulic fluid system, a lubricant system, at least one sensor cable, an electronics module in communication with the at least one sensor cable, the hydraulic fluid system, and the lubricant system. A housing of the control unit contains the hydraulic fluid system, the lubricant system, the sensor cable(s), and the electronics module.

19 Claims, 8 Drawing Sheets

MODULAR CONTROL SYSTEMS WITH UMBILICAL DEPLOYMENT

BACKGROUND

Drilling and well systems typically employ a number of different equipment units, which may require a number of different operational systems. For example, a tree, also referred to as a Christmas tree, may include a set of valves, spools, and fittings connected to the top of a well to direct and control the flow of fluids from the well. Trees may be installed, for example, on wells for fracturing operations (referred to as a frac tree), on a well for production (referred to as production trees), or on a subsea well (e.g., a horizontal tree designed to minimize the assembly height and reduce sway from surrounding water currents). Valves used with trees may be actuated using hydraulic pressure, which may be supplied by a hydraulic pressure unit (HPU). Such valves are supplied with hydraulic pressure using a hydraulic system, where the hydraulic system may also be used to supply hydraulic pressure to other valves and equipment units. Control of a main hydraulic system may also include use of electrical cables for sending and receiving electrical signals and instructions to monitor and control operation of each component using hydraulic pressure.

Additionally, valves and other components in well equipment units may be periodically lubricated to ensure proper functionality. Lubricant (e.g., grease) may be pumped into the valve or other well equipment component from a central lubrication system through lubricant hoses.

Master control units are often used to control operation of one or more of the systems in a well operation. For example, a control unit may be used to operate sub-controllers for different systems in the well operation, such as a sub-controller for a hydraulic system and a sub-controller for a lubrication system. Control units may include automatic programming to perform one or more functions under a preset condition, or control units may be operated on a case-by-case basis.

FIG. 1 shows an example of a convention well system 100 having multiple frac trees 110 assembled at a well site. Each frac tree 110 may include multiple valves 112 (e.g., more than 8 valves), connections, and flow lines to direct and control the flow of fluids into the well. Valves 112 in a frac tree 110 may be hydraulically actuated using hydraulic pressure supplied by a centrally located HPU 120. Additionally, each valve 112 actuator may include two piston chambers connected to the HPU 120 through different hydraulic hoses 122 (hoses that carry hydraulic fluid). Thus, depending on the number of hydraulically operated valves 112 in each frac tree 110, dozens of hydraulic hoses 122 may be required to connect all of the valve actuators in a single frac tree 110 with the HPU 120. Additional frac trees 110 may likewise use additional HPUs 120 and hydraulic hoses 122 to provide hydraulic actuation to the valves 112 in the additional frac trees 110.

Additionally, an automatic greasing system (AGS) may be provided at the well site in order to keep the valves 112 lubricated. The AGS may include a grease pump 130, e.g., which may be held on a trailer 135 with an air compressor 132 for pump operation, a central controller 134, individual lubrication units 136, and grease lines 138 fluidly connecting the components of the AGS.

A master control unit 140 may be used to control operation of one or more systems at the well site, including as the hydraulic system and the AGS. As shown, electrical cables 144 may be provided between the master control unit 140, the AGS central controller 134, and a controller for the HPUs 120 to the different frac trees 110 to send communication signals between the different systems (e.g., signals including instructions for operation of one or more component in the systems). Additionally, sensors 150 may be positioned in various locations at the well site to monitor operations, where sensor data may be processed by the master control unit 140.

By providing a centralized system for each functionality, such as a centralized hydraulic system and a centralized lubrication system, a single master control system may be used to monitor and manage the well site. However, in typical well systems, such as shown in FIG. 1, hundreds of feet of hydraulic hoses 122, grease lines 138, and electrical cables 144 are often used for system functioning, which can lead to complications during the well system set-up, take-down, and maintenance when trying to keep track of which line goes where.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to control units that include a hydraulic fluid system, a lubricant system, at least one sensor cable, an electronics module in communication with the sensor cable(s), the hydraulic fluid system, and the lubricant system, and a housing containing the hydraulic fluid system, the lubricant system, the sensor cable, and the electronics module. The hydraulic fluid system may include a hydraulic fluid flowline extending between a main hydraulic inlet and a main hydraulic outlet, a plurality of hydraulic fluid valves positioned along the hydraulic fluid flowline, and a plurality of hydraulic fluid ports, wherein each hydraulic fluid port is fluidly connected to one of the hydraulic fluid valves. The lubricant system may include a lubricant flowline extending between a main lubricant inlet and a main lubricant outlet, a plurality of lubricant valves positioned along the lubricant flowline, and a plurality of lubricant ports, wherein each lubricant port is fluidly connected to one of the lubricant valves. The sensor cable(s) may extend between a sensor port and the electronics module.

In another aspect, embodiments disclosed herein relate to systems that include a modular asset control unit, a well equipment unit comprising at least one valve, and an umbilical connecting the modular asset control unit to the at least one valve of the well equipment unit. The modular asset control unit may include a hydraulic fluid system, a lubricant system, at least one sensor cable, an electronics module, and a housing holding the hydraulic fluid system, the lubricant system, the sensor cable(s), and the electronics module. The umbilical may have at least one hydraulic hose fluidly connecting the hydraulic fluid system to the valve and a lubricant hose fluidly connecting the lubricant system to the valves.

In yet another aspect, embodiments disclosed herein relate to methods that include providing multiple well equipment units at a well site, connecting multiple modular asset control units to the well equipment units in a one-to-one ratio with the well equipment units using at least one umbilical, such that each of the modular asset control units is connected to one of the well equipment units, connecting the multiple modular asset control units together in series using a connection supply umbilical, connecting a first modular asset control unit of the multiple modular asset control units to a distribution center with the connection supply umbilical, and providing hydraulic pressure and a lubricant to at least one valve on the well equipment unit from the distribution center through the connection supply umbilical, the modular asset control units, and the umbilical.

Other aspects and advantages of the claimed subject matter will be apparent from the following description and the appended claims.

DETAILED DESCRIPTION

Embodiments disclosed herein include modular asset control units (ACU) that may be deployed on a per asset basis, where a single ACU may be used to control, monitor, and/or maintain valves on the asset. In systems using multiple valved assets, an ACU according to embodiments of the present disclosure may be provided for each one of the assets, or in some embodiments, an ACU may be provided for less than all assets in a system. ACUs may be connected together in series with a master control center to distribute valve control functionality from the master control center to each of the connected assets. In such manner, ACUs may be used for control of the valves in an entire system using a streamlined connection system. Additionally, ACUs disclosed herein may be modularized, such that an ACU may be deployed with different types of assets for different operational jobs.

An asset may include valved well equipment units, such as a tree, a missile, a zipper manifold, a fracturing manifold, other well equipment used in fracturing operations, manifolds having one or more valves, well equipment units used for drilling a well (in well drill out operations), well equipment units used for flowback operations, well equipment units used in other completion operations, and other well equipment having one or more valves, as well as control choke manifolds, junk catchers, and other well equipment units used in drilling and/or production operations. Well equipment units used in well operations often use a configuration of valves to direct or stop the flow of fluids used in the well operation. In some well operations, such as hydraulic fracturing operations, hydraulically actuated valves may be used to control the flow of high pressure fluids. For example, a missile includes an assembly of valves and flowlines that allows fracturing fluid to enter at a low pressure, where the fracturing fluid may be directed to fracturing pumps for pressurization, and the high pressure fluid returns to the missile to be directed to a well or fracturing manifold. A zipper manifold may include an assembly of fracturing valves and may be used to direct treatment fluid from a missile to multiple fracturing trees.

According to embodiments disclosed herein, valve control and monitoring systems in an ACU, such as a hydraulic fluid system, a lubricant system, and a sensor and electronics system, may be connected to one or more or all of the valves on a well equipment unit (asset) to control, monitor, and/or maintain the valve(s). Additionally, ACUs disclosed herein may be connected to valves on one or more well equipment units at a well site in a one-to-one ratio, such that multiple ACUs may control and monitor valves in a corresponding number of well equipment units. ACUs disclosed herein may be used to control and monitor different types of valves including, for example, hydraulically actuated valves, electronically activated valves, and manual valves.

Figure 1:
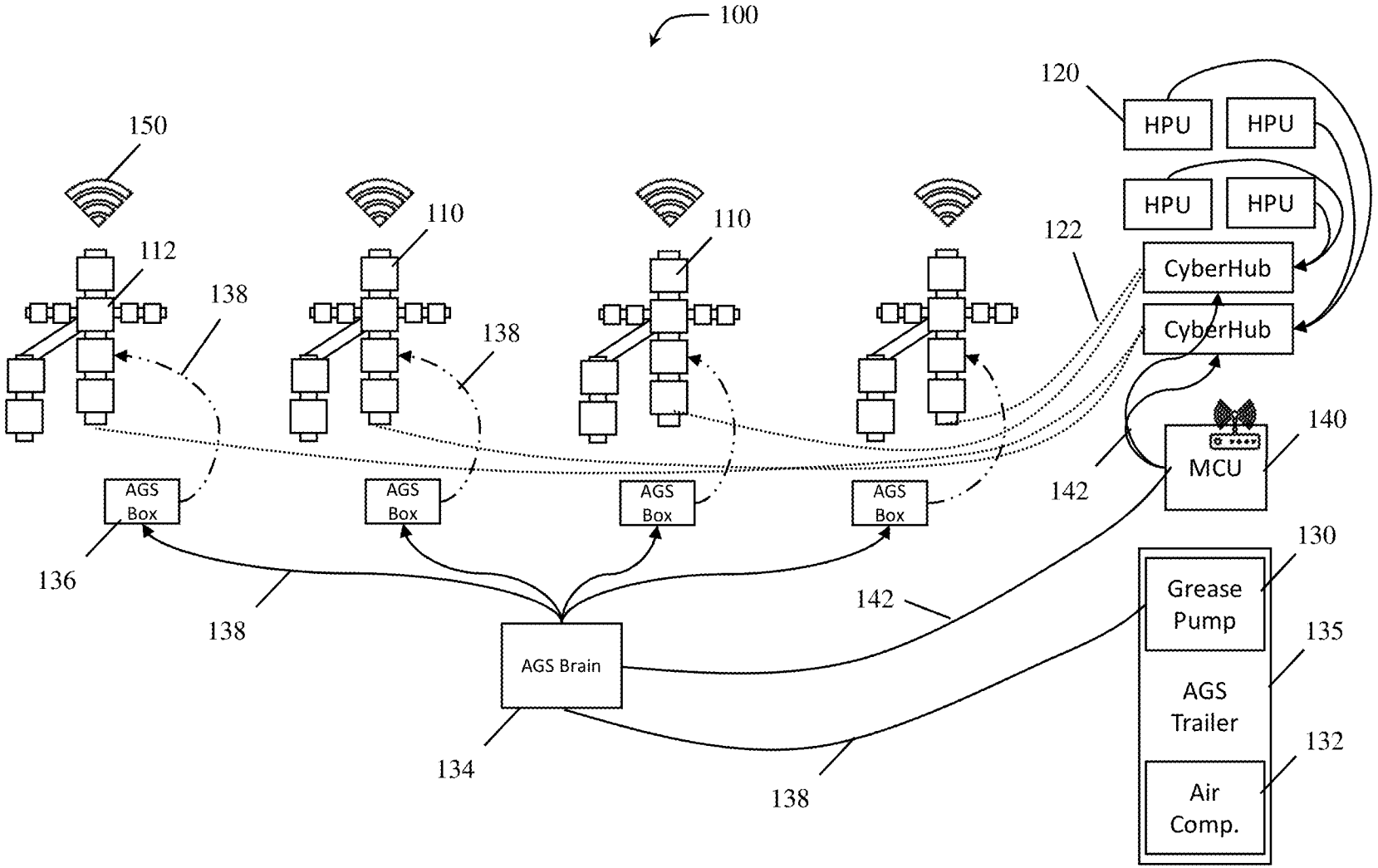
FIG. 1 (Prior Art)
FIG. 1 shows a schematic of a conventional well system.
Figure 2:
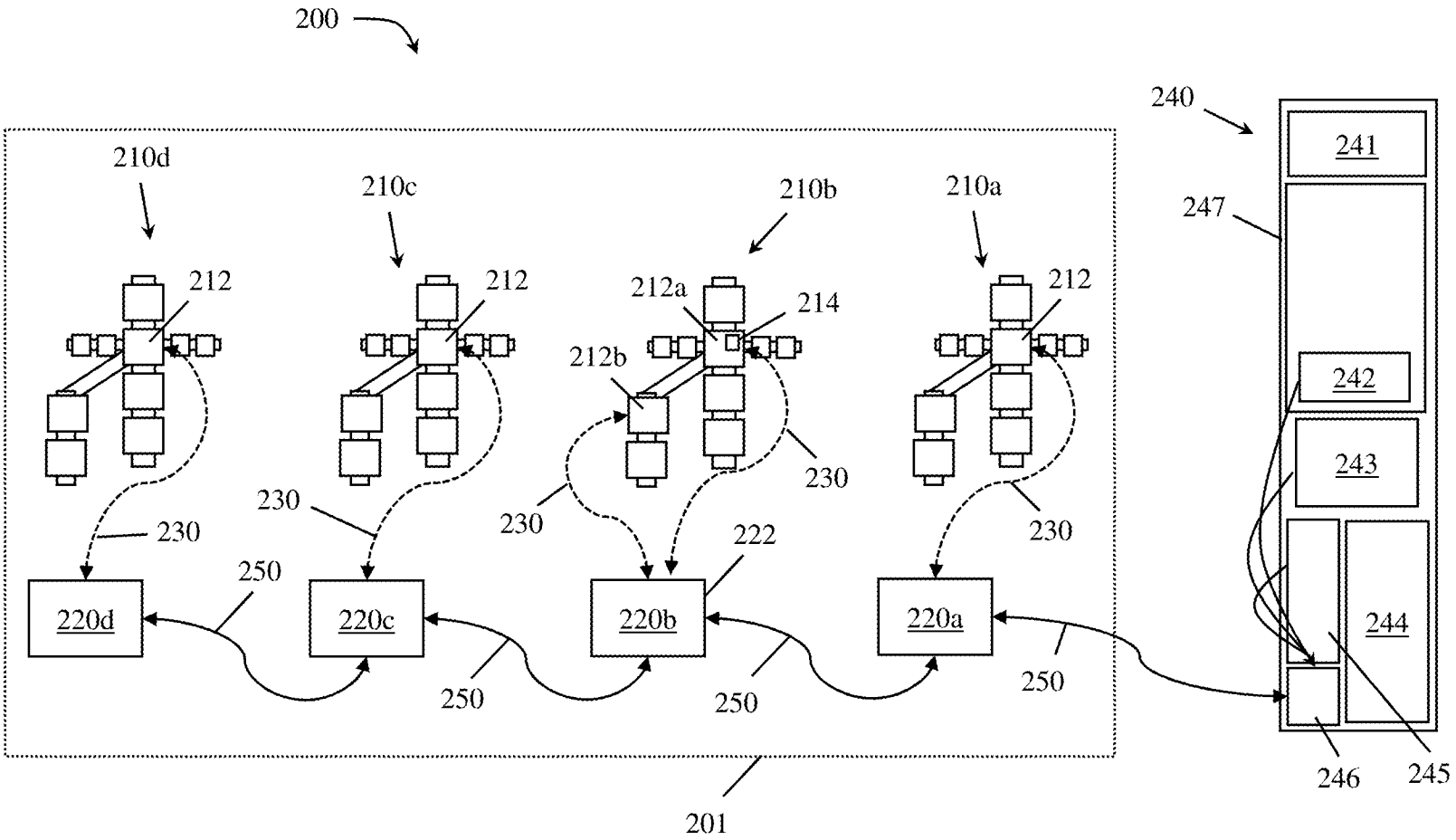
FIG. 2 shows a well system according to embodiments of the present disclosure.

FIG. 2 shows an example of a well site system 200 according to embodiments of the present disclosure, where well equipment units (210*a*, 210*b*, 210*c*, 210*d*, collectively referred to as 210) used at the well site may each be connected to an ACU (220*a*, 220*b*, 220*c*, 220*d*, collectively referred to 220). An ACU 220 according to embodiments of the present disclosure may contain valve control and monitoring systems, such as a hydraulic fluid system, a lubricant system, a sensor system, and an electronics module. An ACU 220 may be connected to a well equipment unit 210 by connecting the valve control and monitoring systems in the ACU 220 to one or more or all of the valves 212 on the well equipment unit 210 using an umbilical 230. An "umbilical" connecting an ACU to an asset (well equipment unit) may collectively house hydraulic hoses, lubricant hoses, and other lines for connection of components on the asset to the ACU. For example, the umbilical 230 may include at least one hydraulic hose fluidly connecting a hydraulic fluid system in the ACU 220 to a hydraulically actuated valve 212, a lubricant hose fluidly connecting a lubricant system in the ACU 220 to the valve 212, and/or a sensor line connecting a sensor cable in the ACU 220 to one or more sensors 214 on the valve 212.

Multiple cables, lines, or hoses (e.g., hydraulic fluid hoses, lubricant hoses, and electrical or other sensor lines) may be bundled together in an umbilical 230 to provide a standardized umbilical 230 that may be used to connect ACUs 220 to multiple different types of valves in different types of well equipment units 210. When connecting an ACU 220 to a valve 212 that does not use one or more valve control and monitoring systems (e.g., valves that do not have a sensor or valves that are not hydraulically actuated), the corresponding line in the umbilical 230 may be capped. For example, in some embodiments, the umbilical 230 may be used to connect an ACU 220 to a non-hydraulically actuated valve (e.g., a manual valve or an electronic valve). In such cases, hydraulic hoses in the umbilical 230 may be capped, while other cables, lines, or hoses may be connected to the valve 212.

Figure 3:
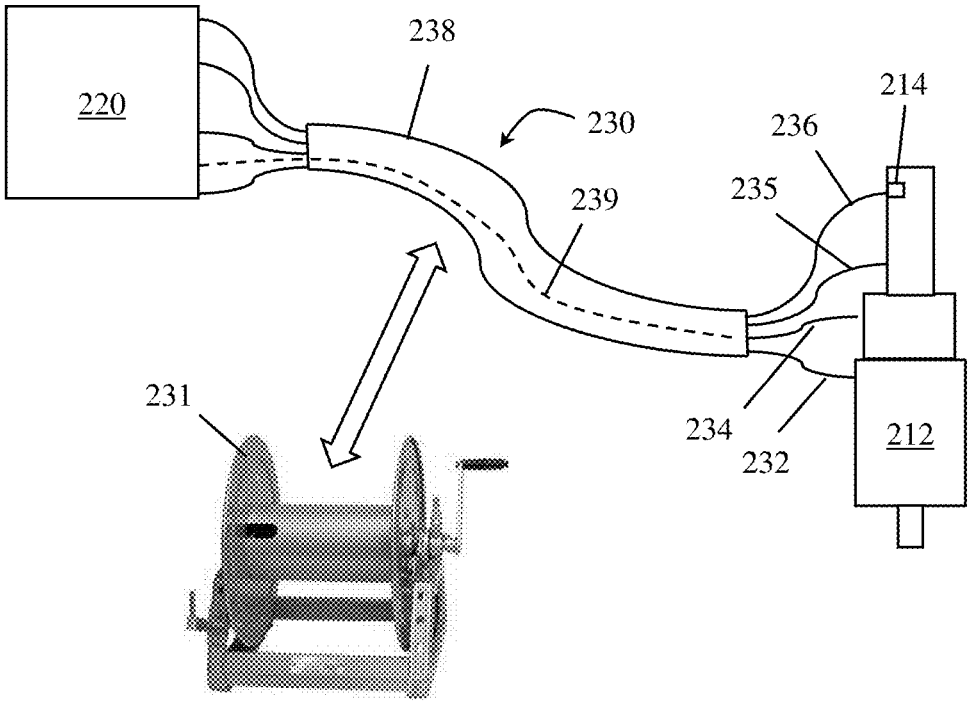
FIG. 3 shows a connection between a valve and an ACU according to embodiments of the present disclosure.
Figure 4:
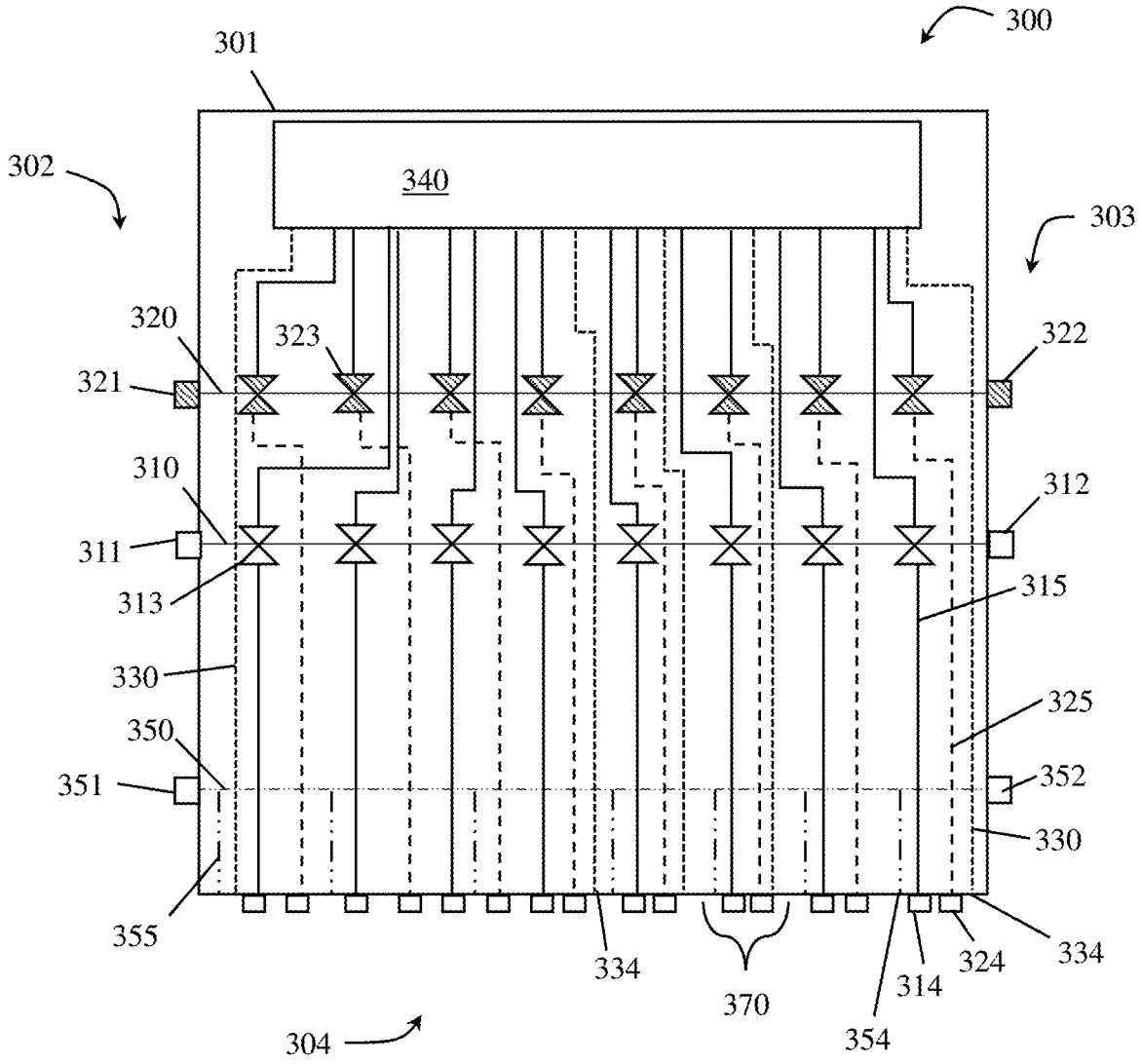
FIG. 4 shows a schematic of an ACU according to embodiments of the present disclosure.

For example, FIG. 3 shows a schematic of an example connection between an ACU 220 according to embodiments of the present disclosure and a hydraulically actuated valve 212 (which may be provided in a well equipment unit 210, shown in FIG. 2) using a umbilical 230. The umbilical 230 may include a lubricant hose 232, which may fluidly connect a lubricant system in the ACU 220 to a valve gate or other lubricated component in the valve 212. The umbilical 230 may also include two hydraulic hoses, including a hydraulic pressure hose 234 and a hydraulic return hose 235, which may be fluidly connected between a hydraulic fluid system in the ACU 220 and a dual acting hydraulic actuator in the valve 212. In some embodiments, a hydraulic pressure hose 234 may be fluidly connected to a single acting hydraulic valve, while a hydraulic return hose 235 may either be capped or not provided in the umbilical 230. The umbilical 230 may also include a sensor line 236 to connect a sensor 214 (e.g., a position sensor) on the valve 212 to a sensor cable in the ACU 220.

In some embodiments, the umbilical 230 may optionally include a heat tracing line 239, which may be connected to a heat tracing cable in the ACU 220. A heat tracing system, including heat tracing line 239, may be used to maintain a temperature (or temperature range) of pipes or vessels. A heat tracing line and/or cable may include a conductive element running through the line that gets hot as current is run through the conductive element. A power source, such as a generator, may power the current through the heat tracing line to heat the line. A thermostat and controller may also be used to monitor and control the amount of heat being output by the heat tracing line. Heat tracing operating components such as a power source and controller may be positioned away from the well equipment units 210 and ACUs 220 and may be connected to heat tracing lines 239 in the umbilical 230 via heat tracing cables connected through the ACU 220.

The hoses and lines 232, 234, 235, 236 may be bundled together in a sheath 238, which may keep the hoses and lines together and organized. In embodiments having a heat tracing line 239 provided in the umbilical 230, the heat tracing line 239 may be bundled with the remaining hoses and lines 232, 234, 235, 236 in the sheath 238. In other embodiments, the heat tracing line 239 may be integrated with the sheath 238 to provide an overall heat tracing to the bundled hoses and lines. For example, conductive elements of a heat tracing line 239 may run through one or more layers of polymer materials (e.g., a thermoplastic layer or other insulating material) forming the sheath 238 along the length of the sheath 238, where appropriate power connections to the conductive elements may be provided at the axial ends of the sheath 238.

Additionally, by bundling the hoses and lines of an umbilical 230 together, the umbilical 230 may be spooled on a spool 231 for easy rig-up and take-down. In some embodiments, a large spool 231 may hold up to 400 ft or more of the umbilical 230 and may be used to provide umbilicals 230 for between 5 and 10 (or more) connections between an ACU 220 and a valve 212.

As mentioned above, umbilicals 230 may be standardized, where the same type of umbilical (including the same bundled lines) may be used for multiple different connections. The standardized umbilical 230 may be stored on a spool 231 and unwound and used for set-up of a well equipment unit 210. When one or more hoses or lines in the standardized umbilical does not need to be used for connection to a valve, the un-used hose/line may be capped. In such manner, standardized umbilicals 230 may be used to connect multiple ACUs 220 to each of their associated well equipment units 210, whether or not the same valve types are being connected.

Referring again to FIG. 2, an ACU 220 may distribute valve control and monitoring functionality to and from a distribution center 240. A distribution center 240 may provide the main source of power, fluids, and other components used for proper valve functioning, including, for example, a power source 241 (e.g., one or more generators), a master control unit 242 (which may include one or more computing systems used to control and monitor operations of one or more systems in the well site 200), a lubricant system 243 (e.g., including a lubricant source and one or more pumps), an HPU (hydraulic pressure unit) 244 (which may include a hydraulic fluid source and one or more pumps), a valve control system 245, and a distribution system 246 for directing selected amounts of fluids or power to the ACUs 220. A distribution center 240 may have its components and systems provided on a single trailer 247 in a compact and/or modular configuration, as shown in FIG. 2. In other embodiments, components and systems of a distribution center may be provided separately from each other.

The distribution center 240 may be located a distance away from the ACUs and the well equipment units 210. For example, in some embodiments, the distribution center 240 may be located outside of a red zone 201, while the ACUs 220 are connected to the equipment units 210 inside the red zone 201, where the red zone 201 may define a safety zone or area around pressurized well equipment units 210, which poses danger for people to enter while the pressurized well equipment units 210 are running. In some embodiments, the distribution center 240 may be located outside a zone ranging from about a 20 to 60-foot radius around the well equipment units 210 of an active well operation.

Connection supply umbilicals 250 may be used to connect the distribution center 240 to the ACUs 220 in series. For example, a main connection supply umbilical 250 may connect a first ACU 220*a* to the distribution center 240, a second ACU 220*b* to the first ACU 220*a*, a third ACU 220*c* to a second ACU 220*b*, and so forth, in a daisy-chain configuration to connect all the ACUs 220 in the system 200 to the distribution center 240. In such manner, multiple ACUs 220 may be connected together in series with a distribution center 240 to distribute valve control functionality from the distribution center 240 to each of the connected assets.

The connection supply umbilical 250 may include, for example, two hydraulic supply hoses (e.g., a hydraulic pressure hose and a hydraulic return hose), which may be fluidly connected to the HPU 244 in the distribution center 240, a lubricant supply hose, which may be fluidly connected to the lubricant system 243 in the distribution center 240, at least one power cable, such as an electrical cable connected to the power source 241 and/or the valve control system 245 in the distribution center 240, and communication cable, such as an ethernet cable. Similar to the umbilical 230, the connection supply umbilical 250 may be standardized and bundled to include the same hoses and lines. As the main connection supply umbilical 250 may provide hydraulic fluids and grease to multiple assets 210 serially, supply and return hoses for each respective connection supply umbilical 250 should be of sufficient size to provide for the needed flow volumes. Thus, in some embodiments, connection supply umbilical 250 may have a larger diameter than the umbilical 230 connecting the ACUs 220 to valves.

Each ACU 220 may have a housing 222 holding the components of the ACU, e.g., a hydraulic fluid system, a lubricant system, at least one sensor cable, and an electronics module. In some embodiments, ACUs 220 may be modularized, such that each ACU 220 may have the same configuration, e.g., the same shape and size of housing 222 and the same components therein. By modularizing the ACUs 220, the ACUs 220 may be interchangeable to use with different well equipment units and at different well sites. Additionally, modularizing the ACUs 220 may allow for easier connection set-ups. For example, a modularized ACU 220 may be designed to have main inputs to the systems therein (e.g., a main hydraulic inlet and a main lubricant inlet) positioned on an inlet side of the housing 222, the main outlets to the systems therein (e.g., a main hydraulic outlet and a main lubricant outlet) positioned on an outlet side of the housing 222, and/or feed ports to each of the systems (e.g., hydraulic fluid ports, lubricant ports, and sensor ports) positioned on another side of the housing 222. In other embodiments, main inputs, main outputs, and/or feed ports may be provided in other configurations around an ACU housing 222 but may be positioned in the same location on each ACU 220*a*, 220*b*, 220*c*, 220*d*, such that connection points may be easily found for connecting umbilicals 230 and connection supply umbilicals 250.

For example, in some embodiments, a first ACU 220*a* may be connected to the distribution center 240 by connecting a connection supply umbilical 250 from the distribution center 240 to an inlet side of the first ACU 220*a*. A connection supply umbilical 250 may also be used to connect an outlet side of the first ACU 220*a* to an inlet side of a second ACU 220*b*; to connect an inlet side of a third ACU 220*c* to the outlet side of the second ACU 220*b*; and so forth. The connection supply umbilicals 250 for each connection may be standardized to have the same components. Additionally, the inlet sides of the first, second, and third ACUs 220*a*, 220*b*, 220*c* may have the same configuration, which may allow for faster connection set-up.

A first well equipment unit 210*a* may be connected to the first ACU 220*a* via an umbilical 230, where the umbilical 230 may be connected between one or multiple valves 212 on the first equipment unit 210*a* and a feed port side of the first ACU 220*a*. A second well equipment unit 210*b* may be connected to the second ACU 220*b* via an umbilical 230, where one segment of umbilical 230 may be connected between a first valve 212*a* on the second equipment unit 210*b* and a feed port side of the second ACU 220*b*, and where another segment of umbilical 230 may be connected between a second valve 212*b* on the second well equipment unit 210*b* and the feed port side of the second ACU 220*b*. Likewise, an umbilical 230 connection between the third ACU 220*c* and the third well equipment unit 210*c* may include connecting the umbilical 230 from a valve on the third equipment unit 210*c* to a feed port side of the third ACU 220*c*. While the system shown in FIG. 2 shows umbilical connections between a single ACU and one valve (e.g., on the first, third, and fourth equipment units 210*a*, 210*c*, 210*d*) and umbilical connections between a single ACU and two valves (212*a*, 212*b* on the second equipment unit 210*b*), umbilical connections may be made between a single ACU 220 and multiple valves (including more than two valves) on an equipment unit. In this manner, hydraulics, greasing, monitoring and control may be connected to each valve of an asset as needed. Additionally, the umbilical 230 may be standardized to have the same components, and the feed port sides of each ACU 220 may have the same configuration to allow for faster connection set-up.

Figure 5:
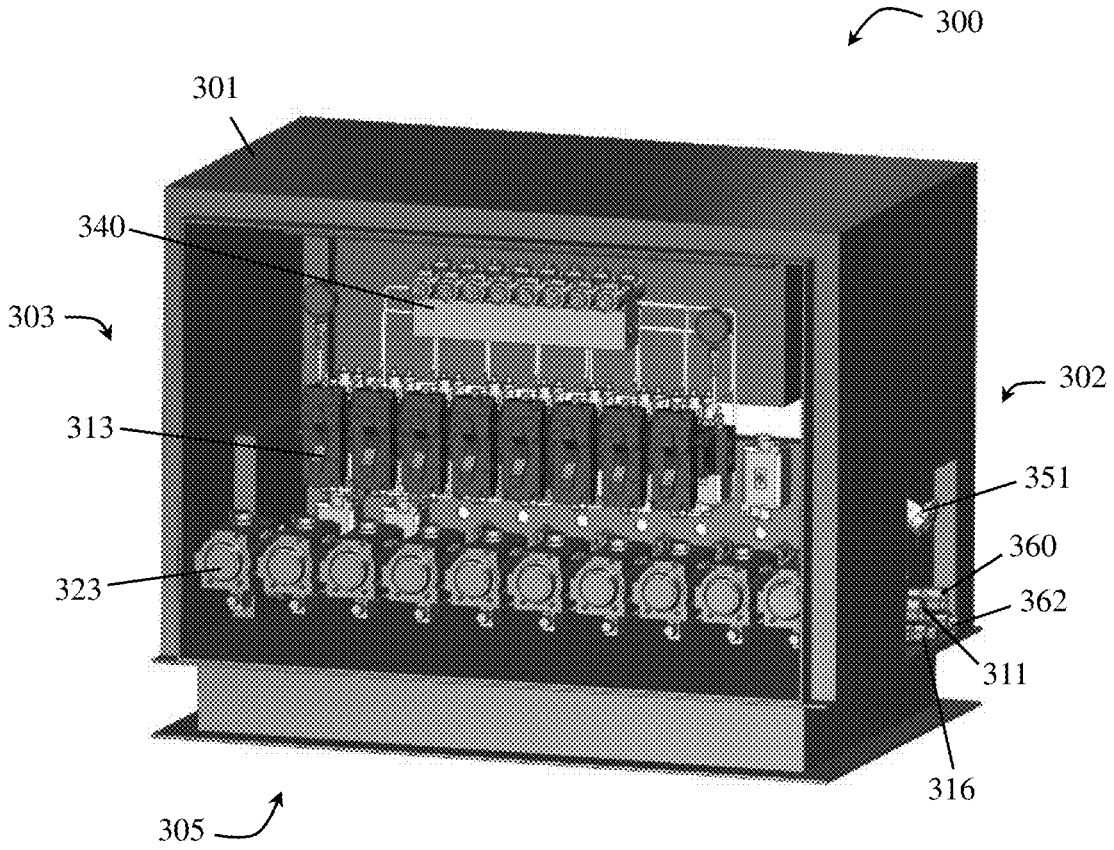
FIG. 5 shows a valve side of the ACU in FIG. 4.
Figure 6:
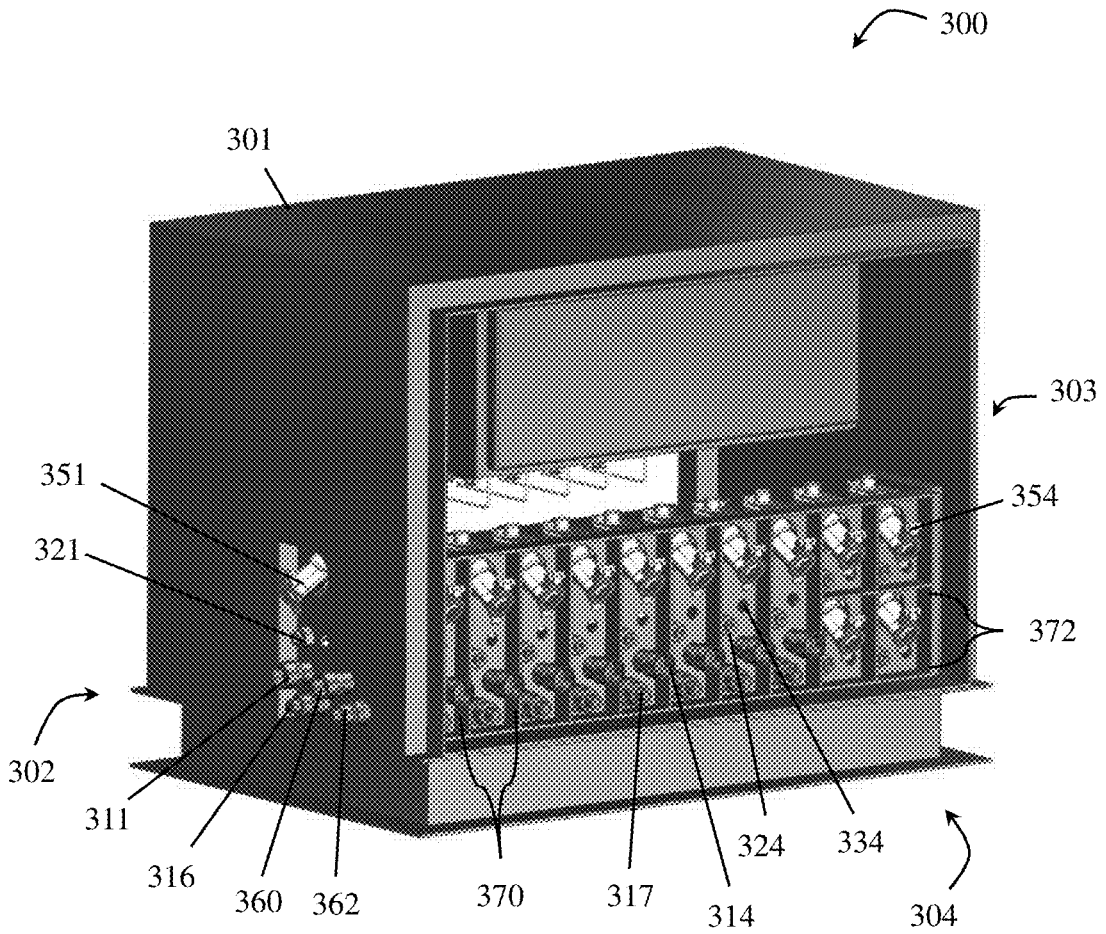
FIG. 6 shows a feed port side of the ACU in FIGS. 4 and 5.
Figure 7:
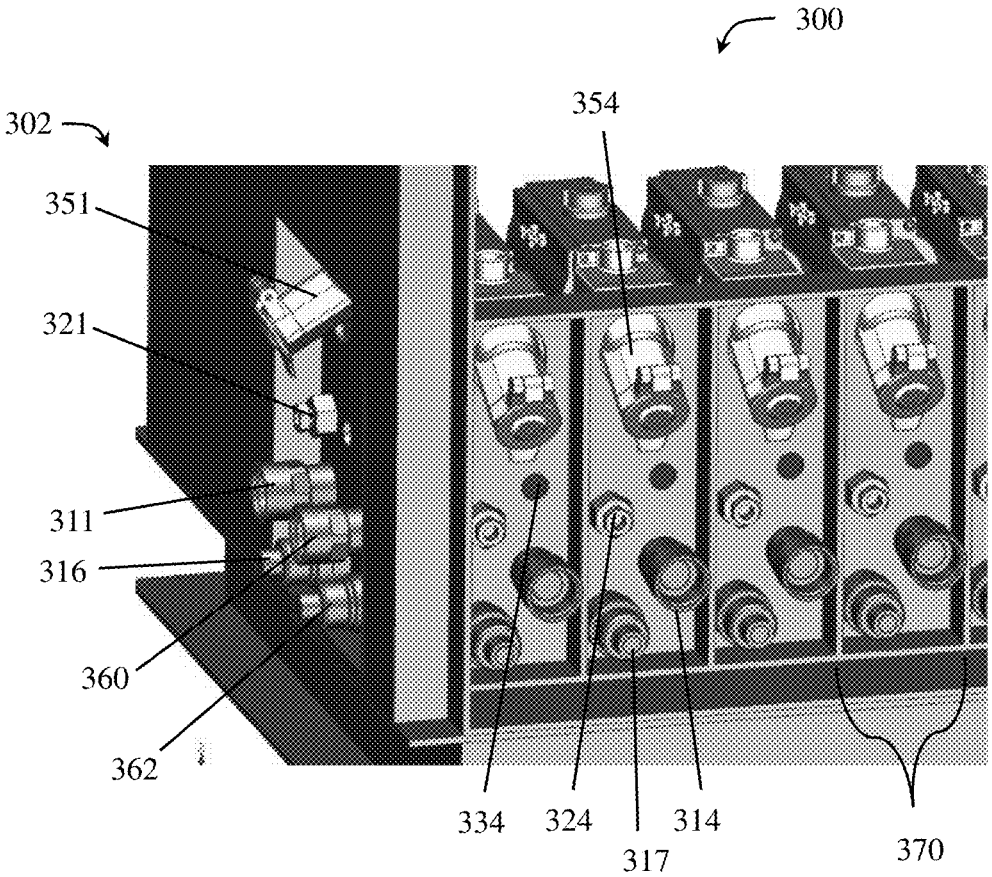
FIG. 7 shows a partial perspective view of the ACU in FIGS. 4-6.

Referring now to FIGS. 4-7, FIG. 4 shows a schematic of an example of an ACU 300 according to embodiments of the present disclosure, FIG. 5 shows a perspective view of a valve side of the ACU 300, FIG. 6 shows a perspective view of a feed port side of the ACU 300, and FIG. 7 shows a zoomed in view of part of the ACU 300.

According to embodiments of the present disclosure, an ACU 300 may include multiple valve control and monitoring systems held in a housing 301. The housing 301 may be an open frame, a box having windows for access to the systems therein, or other frame and wall configuration.

The ACU 300 may have a hydraulic fluid system that includes a hydraulic fluid flowline 310 (e.g., a hydraulic pressure line) extending between a main hydraulic inlet 311 and a main hydraulic outlet 312, a plurality of hydraulic fluid valves 313 positioned along the hydraulic fluid flowline 310, and a plurality of hydraulic fluid ports 314, wherein each hydraulic fluid port 314 may be fluidly connected to one of the hydraulic fluid valves 313 (e.g., via hydraulic port lines 315).

In some embodiments, the hydraulic fluid system in the ACU 300 may further include a secondary hydraulic fluid flowline, e.g., a hydraulic return line, extending between a second main hydraulic inlet (not shown) and a second main hydraulic outlet (316). A plurality of secondary hydraulic fluid ports 317 may be fluidly connected to the secondary hydraulic fluid flowline via at least one valve. In some embodiments, a hydraulic fluid valve 313 may be positioned along both the primary hydraulic fluid flowline 310 and the secondary hydraulic fluid flowline, where a hydraulic fluid valve 313 may selectively allow hydraulic fluid flow from both the primary hydraulic fluid flowline 310 to a hydraulic fluid port 314 and from the secondary hydraulic fluid flowline to a secondary hydraulic fluid ports 317. In other embodiments, hydraulic fluid valves 313 may selectively allow hydraulic fluid flow from the primary hydraulic fluid flowline 310 to the hydraulic flow ports 314, and different, secondary hydraulic fluid valves may selectively allow hydraulic fluid flow between the secondary hydraulic fluid flowline and the secondary hydraulic flow ports 317.

Hydraulic fluid valves may have various configurations that may provide hydraulic fluid flow through serially connected together ACUs (e.g., as shown in FIG. 2) while also controlling hydraulic fluid flow to and from the connected assets as required to operate the valves of the associated asset as instructed. Thus, hydraulic fluid valves (e.g., 313) may be provided along the hydraulic fluid flowlines such that operation of one of the hydraulic fluid valves does not affect hydraulic fluid flow to other serially connected ACUs.

The ACU 300 may also have a lubricant system that includes a lubricant flowline 320 extending between a main lubricant inlet 321 and a main lubricant outlet 322, a plurality of lubricant valves 323 positioned along the lubricant flowline 320, and a plurality of lubricant ports 324, wherein each lubricant port 324 may be fluidly connected to one of the lubricant valves 323 (e.g., via lubricant lines 325).

Similar to the hydraulic fluid valves, lubricant valves may have various configurations that may provide lubricant flow through serially connected together ACUs (e.g., as shown in FIG. 2) while also controlling lubricant flow to and from the connected assets as required to lubricate the valves of the associated asset as instructed. Thus, lubricant valves 323 may be provided along the lubricant flowline 320 in a configuration that allows operation of the lubricant valves without preventing lubricant flow to other serially connected ACUs.

The ACU 300 may also include at least one sensor cable 330 extending between a at least one sensor port 334 and an electronics module 340 in the ACU 300. When the ACU 300 is connected to a valve having at least one sensor, the sensor cable(s) 330 and connected sensor ports 334 may receive and transmit data captured by the valve sensor(s), such as valve positioning, pressure sensing, and equipment monitoring.

The ACU 300 may also include an electronics module 340 in communication with the sensor cables 330, the hydraulic fluid valves 313, and the lubricant valves 323. The electronics module may include, for example, a controller and other computing hardware capable of sending and receiving signals to open or close a valve, transmitting sensor data, and sending/receiving signals to turn on and off switches (e.g., power switches). The electronics module 340 may send and receive signals from a distribution center (e.g., a master control unit in the distribution center) wirelessly or via cables in a connection supply umbilical (e.g., 250 in FIG. 2). For example, a power cable and a communication cable extending through a connection supply umbilical may power and send signals to the electronics module 340, and then the electronics module 340 may then send signals to operate the valve. When the ACU 300 is connected to a valve having at least one sensor, the sensor cable 330 and connected sensor port 334 may receive and transmit data captured by the valve sensor(s) to the electronics module 340, where the electronics module 340 may transmit the sensor data through a network or data cable in the connection supply umbilical (or wirelessly transmit) to a master control unit in the distribution center. Thus, the electronics module 340 in the ACU 300 may act as a center point of communication for the connected asset.

In some embodiments, an ACU 300 may also include a heat tracing cable 350 extending from a heat tracing power inlet 351 to a heat tracing power outlet 352 and a plurality of heat tracing ports 354 in communication with the heat tracing cable 350 via heat tracing lines 355.

Additionally, in some embodiments, ACUs 300 may include remote override lines 360, 362 which may be used to shut down the ACU 300 if needed. Remote override lines may provide a way to bypass the ACU 300, e.g., in an emergency situation, and actuate a valve on the ACU. For example, an ACU may include one or more override line that tees off to one or more hydraulic ports, which may be fluidly connected to one or more valves designated as an override valve. Outside the red zone (or safety zone) around the well equipment unit, a manually operated control manifold or handled valve may be provided and connected to the override valve via the override lines, where the control manifold or valve may be manually operated to send hydraulic power directly to the override valve. In such manner, the override line(s) and control manifold/valve may allow for the connected override valve(s) to be controlled from outside a red zone without going through control communications through the electronics module 340 in the ACU (e.g., in case of an ACU issue or failure).

According to embodiments of the present disclosure, inlets, outlets, and ports to the systems within the ACU 300 may be arranged in selected positions around the housing 301 to facilitate connection set up with other ACUs and valves and provide modularization. For example, in some embodiments, inlets to the systems of the ACU 300 may be positioned on an inlet side 302 of the ACU housing 301, and outlets to the systems of the ACU 300 may be positioned on an outlet side 303 of the ACU housing 301. In the embodiment shown, the main hydraulic inlet 311 and the main lubricant inlet 321 may be positioned on an inlet side 302 of the housing 301. In some embodiments, one or more other connections (e.g., a heat tracing power inlet 351, secondary hydraulic fluid port 316, and/or a remote override inlet) to other systems in the ACU 300 may also be positioned at the inlet side 302 of the housing 301. Additionally, the main hydraulic outlet 312 and the main lubricant outlet 322 may be positioned on an outlet side 303 of the housing 301, opposite the inlet side 302.

As shown in FIG. 5, valves in the ACU 300 may be arranged on the same side of the ACU 300 (e.g., on a valve side 305 of the ACU), which may allow for easier access to the valves in the ACU 300. For example, the lubricant valves 323 and the hydraulic fluid valves 313 may be provided on the valve side of the ACU 300. Additionally, in some embodiments, ports to the systems within the ACU 300 may be arranged on a feed port side 304 of the ACU housing 301. For example, in the embodiment shown, the hydraulic fluid ports 314, the lubricant ports 324, and the sensor ports 334 may be positioned on the same side of the ACU 300. Other ports may also be provided on the feed port side 304, such as heat tracing ports 354 and secondary hydraulic fluid ports 317. In some embodiments, a feed port side 304 of the ACU 300 (having the ports to the systems in the ACU arranged thereon) may be on an opposite side of the ACU from a valve side 305 of the ACU (having the valves to the systems in the ACU arranged thereon).

According to embodiments of the present disclosure, ports from different systems in the ACU 300 may be grouped together in banks 370, 372. The banks 370, 372 of ports may be provided as a consolidated group of ports to allow easier connection of an umbilical to a valve of an asset. As each bank of ports may be associated with a tag or label, the controls and systems may similarly be associated with that bank, thereby allowing for association of a connected asset valve with the proper ports in the ACU. In this manner, in addition to ease of setup and connection, control of the asset valves may be facilitated through the plug-and-play type connectivity with the banks and associated connections.

For example, a hydraulic fluid port 314, optionally a secondary hydraulic fluid port 317, a lubricant port 324, a sensor port 334, and optionally a heat tracing port 354 may be grouped together in a bank 370. According to embodiments of the present disclosure, multiple banks 370 may be provided in an ACU 300 (e.g., at least 2, at least 8, or more banks) for connection to multiple valves, sensors, and other equipment of an asset.

In some embodiments, a group of ports that do not include hydraulic fluid ports may be grouped together in a bank for connection to a non-hydraulically actuated valve (e.g., a manual valve or an electrically actuated valve). For example, a lubricant port 324, a sensor port 334, and optionally a heat tracing port 354 may be grouped together in a non-hydraulic bank 372. According to embodiments of the present disclosure, an ACU 300 may contain at least one non-hydraulic bank, may contain multiple non-hydraulic banks (e.g., 4 non-hydraulic banks 372 as shown in FIG. 6), or may not contain any non-hydraulic banks.

By grouping such ports together in banks 370, 372, an umbilical may easily be connected to the ports in a bank 370, 372 at one end and to a valve at the other end. Separating the ports in groups that may eventually be connected to individual valves may also allow for the connecting lines between the ports and the valves to stay organized by valve. For example, according to embodiments of the present disclosure, a well equipment unit may have multiple hydraulic valves and, optionally, at least one non-hydraulic valve. Segments of umbilical may be connected at one end to different banks 370, 372 in the ACU 300 and at the other end to the different valves on the equipment unit. hydraulically actuated valve at the other end.

Additionally, by grouping connections to valves according to banks 370, 372 in the ACU 300, the connected valves may be assigned by bank 370, 372 using the electronics module 340. For example, a connection to a first bank 370, 372 in the ACU 300 may be labeled in the electronics module 340. As different operations related to the first bank connection occur (e.g., sensor data received from a connected valve, hydraulic fluid valve operations, and lubricant valve operations), such actions may be relayed from the electronics module 340 to the distribution center, which may then be processed in relation to overall operation of the well site.

Embodiments disclosed herein may allow for easier set-up and take-down of well systems, as well as simplified valve control and monitoring of valves used in the well system. Whereas conventionally arranged well systems may have included multiple lines connecting each valve to different centralized systems and individual assignments for each valve, methods and systems according to embodiments of the present disclosure include providing a type of sub-control system controlling multiple systems (via ACUs) on a per asset basis for well equipment units in a well system.

Figure 8:
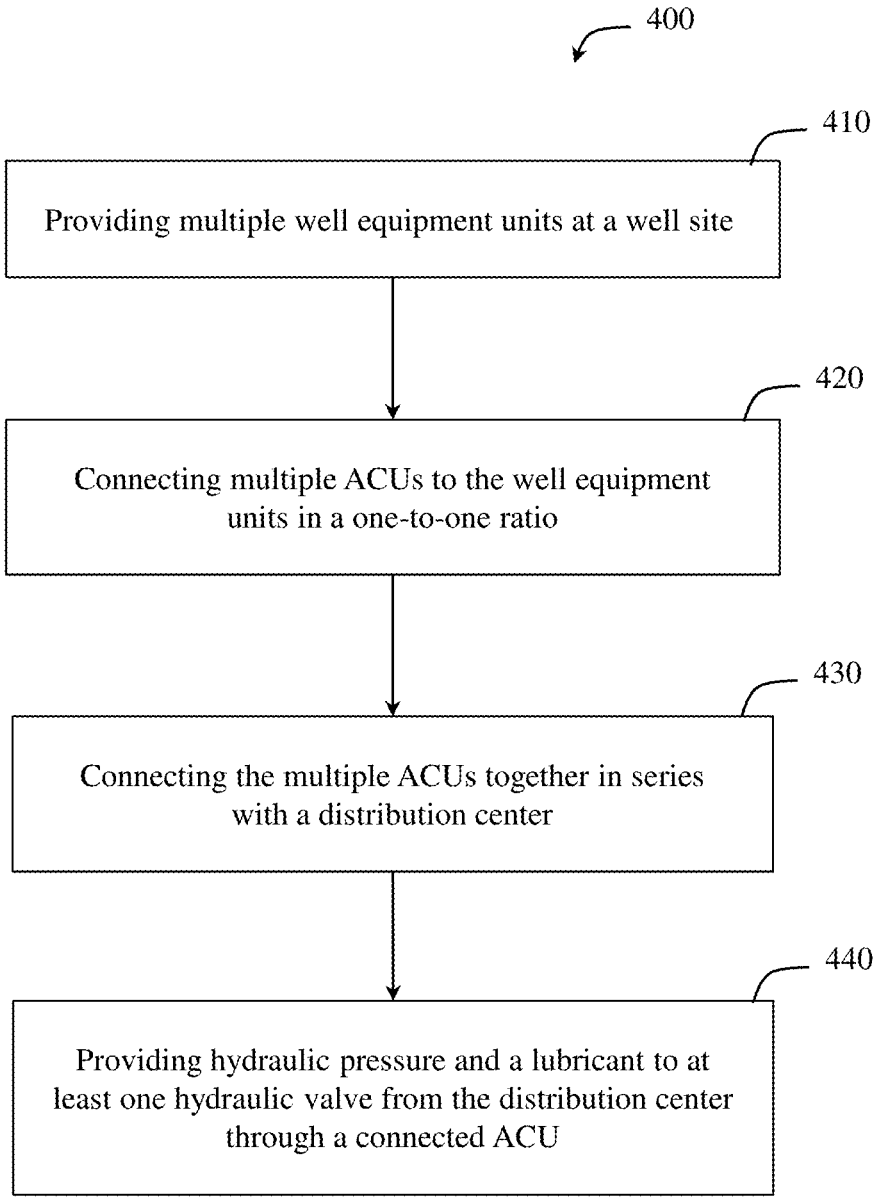
FIG. 8 shows a method according to embodiments of the present disclosure.

FIG. 8 shows an example of a method 400 according to embodiments of the present disclosure for setting up a well site using ACUs, as disclosed herein. The well site may include multiple well equipment units (e.g., a tree, zipper, utility skid, other hydraulic fracturing well equipment, drill out equipment, flowback equipment, or other well completion equipment) provided around at least one well (step 410). Multiple modular ACUs according to embodiments of the present disclosure may be connected to the well equipment units in a one-to-one ratio (step 420), such that each of the modular ACUs is connected to one of the well equipment units. Each ACU may be connected to a corresponding well equipment unit by connecting segments of the umbilical from the ACU to one or more valves on the well equipment unit.

The modular ACUs may be connected together in series with a distribution center (step 430) using a connection supply umbilical, where the distribution center may include a hydraulic pressure unit, a lubricant source and pump, a master control unit, a power source, and other components that may be used for the control and monitoring the equipment units in the well site. For example, a distribution center may be connected to a first modular ACU using a first segment of connection supply umbilical, a second modular ACU may be connected to the first modular ACU using a second segment of connection supply umbilical, and so forth until each of the ACUs are connected.

As an example, the distribution center may be connected to a first ACU, connecting the electronics and control system of the distribution center to the first ACU. As ACU's are connected to the well equipment units (including the valves, sensors, etc. of the well equipment units), the particular asset and valve of the asset may be assigned in the main control and monitoring system of the distribution center as the well equipment units are connected. Alternatively, multiple assets (e.g., frac trees) may be connected to an ACU in an organized manner (e.g., the main valve of the asset to bank #1 of the ACU, the wing valve of the asset to bank #2 of the ACU, etc.), so that the assignments in the main control system may be easily configured. The particular order of connecting the distribution center, ACU's, and assets may vary, but may be performed in a manner so as to facilitate assignment of the connected assets within the main control system of the distribution center.

Once the ACUs are connected to the well equipment units and the distribution center, the ACUs may control and monitor the valves on the well equipment units, for example, by providing hydraulic pressure and a lubricant to the valve(s) from the distribution center through the connection supply umbilical, the modular ACUs, and the umbilical.

By providing ACUs on a per asset basis with the well equipment units, where each connected well equipment unit may be controlled using its corresponding ACU, the well equipment units may be independently run whether or not one of the well equipment units breaks or needs to be shut down. For example, referring to the example well system shown in FIG. 2, a first well equipment unit 210*a* may be shut down, e.g., for maintenance, while continuing to operate (e.g., provide hydraulic pressure and/or lubricant) to at least one valve in the remaining well equipment units 210*b*, 210*c*, 210*d*.

In some embodiments, a label may be assigned for each valve of the well equipment units connected to the ACUs, and a type of well equipment unit may be assigned to each well equipment unit connected to an ACU. Valve and well equipment unit type assignments may be stored in the connected ACUs, which may be used for operating the valve(s) and equipment unit(s) from the distribution center. For example, signal(s) may be sent from a sensor on a valve on a well equipment unit through an umbilical to a connected ACU, where the valve and equipment unit type may be assigned in the ACU. The signal with the corresponding valve and equipment unit type assignments may then be sent through a connection supply umbilical to the distribution center, where the signal may be processed as belonging to the assigned valve and equipment unit type.

In embodiments having ACUs provided with a heat tracing system incorporated therein, the well system may have a winterization option integrated with the set-up. For example, multiple ACUs having a heat tracing system therein may be connected together in series with an HPU (e.g., including a hydraulic fluid source and hydraulic pumps), a lubricant source, and a lubricant pump, which may be provided in a distribution center or other location. A connection supply umbilical may be used to connect the ACUs together in series, where the connection supply umbilical may include a heat tracing cable (either as a separate line bundled inside the connection supply umbilical with other lines, or integrally formed in the connection supply umbilical sheathing) that connects heat tracing cables in the ACUs together. Additionally, each ACU may be connected to a well equipment unit using umbilical that includes heat tracing cable. The heat tracing cable provided in the umbilical may be connected to the heat tracing cables in the ACUs. A power source (e.g., a generator) may provide power to the heat tracing cables, which may generate heat throughout the connected heat tracing cables (in the connection supply umbilical, the ACUs, and the umbilical). The power source may be provided proximate the HPU and lubricant source and connected in series with the ACUs, or the power source may be connected to each ACU via separate connection lines. An integrated heat tracing system included with ACUs and systems according to embodiments of the present disclosure may allow for winterization of the well system without using heaters and added duct work, thereby simplifying winterization and reducing costs.

Additionally, modular ACUs disclosed herein may allow for easy scalability, reorganization, or other changes in a well system, on a per job basis. For example, adding an additional well equipment unit in a well system may include connecting an additional ACU to the additional well equipment unit and connecting the additional ACU to a last ACU in the well system. In such manner, ACUs disclosed herein and methods of using the ACUs to set up a well system may allow implementation of a scalable system to accommodate any future completion program. ACUs disclosed herein may also allow for standardized and simplified connections, which may reduce the onsite footprint and reduce set-up time and costs.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A control unit, comprising:

a hydraulic fluid system, comprising:

a hydraulic fluid flowline extending between a main hydraulic inlet and a main hydraulic outlet;

a plurality of hydraulic fluid valves positioned along the hydraulic fluid flowline;

a plurality of hydraulic fluid ports, wherein each hydraulic fluid port is fluidly connected to one of the hydraulic fluid valves;

a hydraulic fluid return flowline extending between a main hydraulic return inlet and a main hydraulic return outlet; and a plurality of hydraulic fluid return ports fluidly connected to the hydraulic fluid return flowline;

a lubricant system, comprising:

a lubricant flowline extending between a main lubricant inlet and a main lubricant outlet;

a plurality of lubricant valves positioned along the lubricant flowline; and a plurality of lubricant ports, wherein each lubricant port is fluidly connected to one of the lubricant valves;

at least one sensor cable extending between at least one sensor port and an electronics module, wherein the electronics module is in communication with the at least one sensor cable, the plurality of hydraulic fluid valves, and the plurality of lubricant valves; and a housing containing the hydraulic fluid system, the lubricant system, the at least one sensor cable, and the electronics module.

2. The control unit of claim 1, wherein the main hydraulic inlet and the main lubricant supply inlet are positioned on an inlet side of the housing, and wherein the main hydraulic supply outlet and the main lubricant outlet are positioned on an outlet side of the housing, opposite the inlet side.

3. The control unit of claim 1, wherein the hydraulic fluid ports, at least some of the lubricant ports, and at least some of the at least one sensor port are grouped in multiple hydraulic banks, wherein each hydraulic bank comprises at least one of the hydraulic fluid ports, one of the lubricant ports, and one of the at least one sensor ports.

4. The control unit of claim 3, wherein the housing contains at least eight hydraulic banks.

5. The control unit of claim 1, wherein the hydraulic fluid ports, the lubricant ports, and the at least one sensor port are positioned on a same side of the control unit.

6. The control unit of claim 1, further comprising at least one manual valve bank, wherein each manual valve bank comprises one of the lubricant ports and one of the at least one sensor port.

7. The control unit of claim 1, further comprising:

a heat tracing cable extending from a heat tracing power inlet to a heat tracing power outlet; and a plurality of heat tracing ports in communication with the heat tracing cable via heat tracing lines.

8. A system, comprising:

a modular asset control unit, comprising:

a hydraulic fluid system;

a lubricant system;

at least one sensor cable;

an electronics module; and a housing holding the hydraulic fluid system, the lubricant system, the at least one sensor cable, and the electronics module;

a well equipment unit comprising multiple valves; and an umbilical connecting the modular asset control unit to each of the multiple valves of the well equipment unit, wherein the umbilical comprises:

at least one hydraulic hose fluidly connecting the hydraulic fluid system to the multiple valves; and a lubricant hose fluidly connecting the lubricant system to the multiple valves.

9. The system of claim 8, wherein the umbilical further comprises a sensor line connecting the at least one sensor cable to one or more sensors on the at least one valve.

10. The system of claim 8, further comprising:

a second modular asset control unit connected to the modular asset control unit;

a second well equipment unit comprising at least one second valve; and a second umbilical connecting the second modular asset control unit to the at least one second valve of the second well equipment unit.

11. The system of claim 10, wherein an outlet side of the modular asset control unit is connected to an inlet side of the second modular asset control unit via a connection supply umbilical, wherein the connection supply umbilical comprises two hydraulic supply hoses, a lubricant supply hose, and an electrical cable.

12. The system of claim 11, further comprising a third modular asset control unit connected to a third well equipment unit by a third umbilical, wherein an outlet side of the second modular asset control unit is connected to an inlet side of the third modular asset control unit via a second connection supply umbilical, and wherein the second connection supply umbilical has the same components as the connection supply umbilical connecting the modular asset control unit to the second modular asset control unit.

13. The system of claim 8, wherein the modular asset control unit further comprises a heat tracing cable, and wherein the umbilical further comprises a heat tracing line connected to the heat tracing cable.

14. The system of claim 8, further comprising a distribution center located a distance away from the modular asset control unit and the well equipment unit, wherein the distribution center comprises:

a hydraulic power unit;

a master control unit;

a lubricant source;

a power source; and at least one pump; and wherein the modular asset control unit is connected to the distribution center by a connection supply umbilical, the connection supply umbilical comprising:

two hydraulic supply hoses connected to the hydraulic power unit;

a lubricant supply hose connected to the lubricant source; and an electrical cable connected to the power source.

15. The system of claim 8, wherein the modular asset control unit further comprises multiple hydraulic banks of ports to the hydraulic fluid system, the lubricant system, and the at least one sensor cable, and wherein the umbilical is in multiple segments, each segment extending from one of the multiple hydraulic banks to one of the multiple hydraulic valves.

16. A method, comprising:

providing multiple well equipment units at a well site;

connecting multiple modular asset control units to the well equipment units in a one-to-one ratio with the well equipment units, such that each of the modular asset control units is connected to one of the well equipment units, wherein the connecting comprises connecting at least one umbilical from one of the modular asset control units to at least one valve on one of the well equipment units;

connecting the multiple modular asset control units together in series using a connection supply umbilical;

connecting a first modular asset control unit of the multiple modular asset control units to a distribution center with the connection supply umbilical; and providing hydraulic pressure and a lubricant to the at least one valve from the distribution center through the connection supply umbilical, the modular asset control units, and the umbilical.

17. The method of claim 16, further comprising:

shutting down a first well equipment unit of the multiple well equipment units; and while the first well equipment unit is shut down, continuing to provide the hydraulic pressure and the lubricant to the at least one valve in the remaining multiple well equipment units.

18. The method of claim 16, further comprising:

assigning a label for each of the at least one valves in an electronics module of each of the modular asset control units;

assigning a type for the well equipment unit that each modular asset control unit is connected to; and operating the at least one valve from the distribution center by sending at least one signal between the electronic module and a master control unit in the distribution center through the connection supply umbilical.

19. The method of claim 18, wherein the at least one signal is sent from a sensor on the at least one valve through the umbilical and the connection supply umbilical.

* * * * *